US007510135B2

(12) United States Patent
Burchardt et al.

(10) Patent No.: US 7,510,135 B2
(45) Date of Patent: Mar. 31, 2009

(54) GRINDING ROLL

(75) Inventors: Egbert Burchardt, Everswinkel (DE); René Klymowsky, Doorwert (NL); Johann Knecht, Wadersloh (DE); Norbert Patzelt, Beckum (DE)

(73) Assignee: Polysius AG, Beckum (DE)

( * ) Notice: Subject to any disclaimer, the term of this patent is extended or adjusted under 35 U.S.C. 154(b) by 368 days.

(21) Appl. No.: 10/895,707

(22) Filed: Jul. 21, 2004

(65) Prior Publication Data

US 2005/0061901 A1 Mar. 24, 2005

(30) Foreign Application Priority Data

Jul. 31, 2003 (DE) ..... 103 35 115

(51) Int. Cl.

| | |
|---|---|
| ***B02C 1/10*** | (2006.01) |
| ***B02C 7/12*** | (2006.01) |
| ***B02C 13/28*** | (2006.01) |
| ***B02C 15/16*** | (2006.01) |
| ***B02C 17/20*** | (2006.01) |
| ***B02C 23/00*** | (2006.01) |

(52) U.S. Cl. ..... 241/294; 241/300

(58) Field of Classification Search ..... 241/300, 241/294, 182

See application file for complete search history.

(56) References Cited

U.S. PATENT DOCUMENTS 412,558 A * 10/1889 Stephens ..... 241/294
883,619 A * 3/1908 Canda ..... 241/294
1,947,440 A * 2/1934 Milne ..... 241/294
3,195,508 A 7/1965 Lehman et al.
4,319,719 A * 3/1982 Larsen ..... 241/183
4,848,683 A * 7/1989 Kawatsu ..... 241/294
4,871,119 A * 10/1989 Murata et al. ..... 241/189.1
5,114,082 A * 5/1992 Brundiek ..... 241/121
5,318,231 A * 6/1994 Bernhardt et al. ..... 241/236
5,421,290 A 6/1995 Welch
5,794,563 A 8/1998 Klepac
6,086,003 A * 7/2000 Gunter et al. ..... 241/235
6,305,320 B1 10/2001 Fore
6,481,373 B2 11/2002 Swetzig
6,622,653 B1 9/2003 Starnes, Jr.
D486,946 S 2/2004 Castro

FOREIGN PATENT DOCUMENTS

| | | |
|---|---|---|
| DE | 44 00 797 A1 | 7/1997 |
| EP | 0 659 108 B1 | 10/1998 |
| JP | 03047543 A * | 2/1991 |

* cited by examiner

*Primary Examiner*—Bena Miller
(74) *Attorney, Agent, or Firm*—Stites & Harbison PLLC; Ross F. Hunt, Jr.

(57) ABSTRACT

The invention relates to a grinding roll with a basic roll body as well as a plurality of wear protection elements made from hard metal which form at least a part of the roll surface. The basic roll body has recesses extending in the circumferential direction, a plurality of wear protection elements being disposed one behind the other in the circumferential direction in each recess.

16 Claims, 2 Drawing Sheets

GRINDING ROLL

BACKGROUND OF THE INVENTION

In the case of grinding rolls which are used in particular for so-called material bed comminution the problem of high wear on the roll surface arises. It is therefore known to counteract this wear by different shaping and coating of the roll surfaces exposed to the wear. A grinding roll is known from EP-A-0 516 957 in which pin-shaped profiled bodies are disposed on the roll surface, wherein only part of each profiled body is embedded in the basic roll body whilst the remaining part projects like a spine out of the basic roll body. The individual profiled bodies are spaced so that during operation some of the material to be comminuted becomes embedded in the interstices and thereby forms an autogenous wear protection.

In EP-B-0 659 108 a roller press is disclosed in which the roll surface is formed by flat zones which are made from highly wear-resistant material, the interstices between the highly wear-resistant zones being filled with a material having a different wear resistance. The interstitial material is a composite material which can be sintered and the highly wear-resistant zones are formed by hard bodies produced by hot-isostatic pressing, wherein the interstitial material and the material of the wear-resistant zones are fixed on the basic body by a hot-isostatic pressing operation and wherein the wear resistance of the interstitial material is basically slightly higher or lower than the wear resistance of the hard bodies in accordance with a desired profiling which is established due to wear.

Due to the measures described above, the wear on the roll surface could be reduced to an acceptable amount. However, the previously known measures do not constitute sufficient protection for the edges of the rolls or in the case of large rolls cannot be effected or cannot be effected economically, so that it is extremely difficult to introduce the material bed roll mill into the copper/gold industry because of the high wear on the roll surface. In the past the regions of the roll edges were protected by a hard-facing. However, the wear resistance was not sufficient and necessitated frequent re-welding of the rolls in this region. Depending upon the intensity, the service life of the rolls lasts for approximately 2 to 6 weeks, which drastically reduces the availability and involves high repair costs.

The object of the invention, therefore, is to provide a new concept of wear protection for the roll surface.

SUMMARY OF THE INVENTION

The grinding roll according to the invention comprises a basic roll body as well as a plurality of wear protection elements made from hard metal which form at least a part of the roll surface. The basic roll body also has recesses or grooves extending in the circumferential direction, a plurality of wear protection elements being disposed one behind the other in the circumferential direction in each groove. In this way the wear protection elements form a virtually closed ring which offers a high degree of wear protection.

In a preferred embodiment a circumferential recess in which the wear protection elements are disposed immediately one behind the other is provided at least in the region of each of the edges of the roll.

The wear protection elements can be fixed directly on the basic roll body for example by bonding, clamping or soldering. In a preferred embodiment, however, the wear protection elements are mounted on a retaining body which is made from a material with a lower hardness, in particular steel, than that from which the wear protection elements are formed. The retaining body can be machined substantially easier than the wear protection elements and can therefore be adapted in a simple manner to the basic roll body.

As the wear protection elements project beyond the outer surface of the basic roll body in the region of the roll edges, they take on the function of a bulkhead in this region in order to prevent the material being comminuted from flowing in the axial direction. In this case the surface of the wear protection elements may be smooth or profiled.

THE DRAWINGS

Further advantages and embodiments of the invention are explained in greater detail with reference to the following description and the drawings, in which.

PREFERRED EMBODIMENTS

Figure 1:
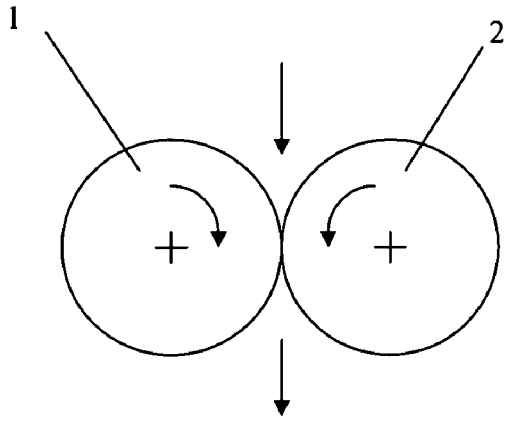
FIG. 1 shows a schematic representation of a roll mill.

For compacting, briquetting and comminution, it is usual for two rolls 1, 2 running in opposite directions to be pressed against one another at high pressure. In so-called material bed comminution pressures of 50 MPa and above are used.

The grinding roll substantially comprises a basic roll body 10 and a plurality of wear protection elements 11, 12, 13, 14, . . . . The wear protection elements are made from hard metal and form at least a part of the roll surface. For fixing of the wear protection elements the basic roll body 10 has grooves 10.1, 10.2, 10.3 extending in the circumferential direction, a plurality of wear protection elements being disposed one behind the other in the circumferential direction in each groove.

The grooves preferably extend over the entire circumference and are provided at least in the region of the two roll ends 10*a*, 10*b*.

The wear protection elements are fixed in the circumferential grooves in such a way that there is no material of the basic roll body between two wear protection elements which are disposed one behind the other in the circumferential direction. Advantageously the distance between the wear protection elements in the circumferential direction on the roll surface is less than 5 mm. The length of the wear protection elements in the circumferential direction is preferably 20 to 100 mm.

Figure 2:
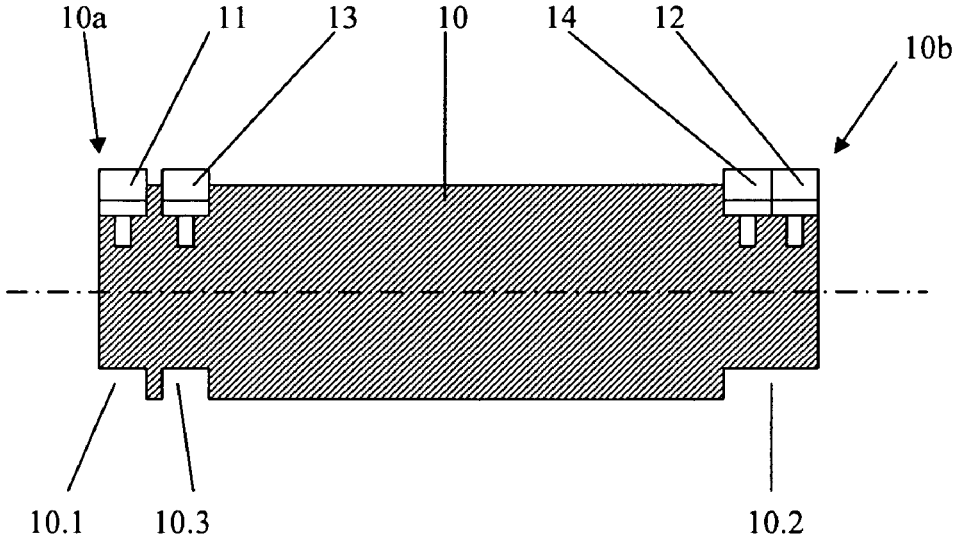
FIG. 2 shows a schematic cross-sectional representation of a grinding roll.
Figure 3:
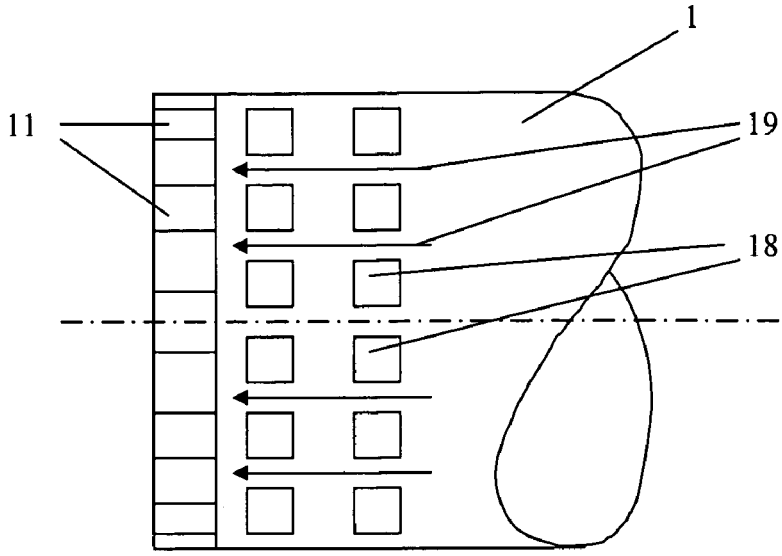
FIG. 3 shows a plan view of the grinding roll in the region of one end of the roll.

The grooves 10.1, 10.3 are dimensioned so that only one wear protection element 11, 13 is disposed in each groove in the axial direction. FIG. 2 shows on the roll end lO*b* a recess 10.2 in which a plurality of wear protection elements 12, 14 can be disposed in the axial direction. However, it is also possible to achieve an effective edge protection if on the roll ends only one circumferential recess is provided in which only one wear protection element is disposed in the axial direction.

The wear protection elements are of angular, preferably rectangular construction in plan view.

In principle the possibility exists of fixing the wear protection elements directly on the basic roll body; this could take place for example by bonding, clamping or hard-soldering.

Another fixing option consists of fixing each wear protection element on a retaining body 15 interposed between the associated wear element and the roll body, the retaining body preferably being made from a material with a lower hardness, particularly steel. The fixing of the wear protection element on the retaining body can be effected for example by bonding, but in particular by hard-soldering.

The retaining body 15 has on its face opposite the wear protection element 11 a lug 16 which co-operates with a corresponding bore 10*c* of complementary shape in the basic roll body 10. In this case fixing can be achieved in particular by glueing the lug in the bore. Therefore the circumferential recesses are provided with a number of bores corresponding to the number of lugs.

The wear protection elements 11, 12 disposed on the edge of the roll are oriented so that with one face 11*a* they form a wear protection for the roll outer surface and with a face 11*b* disposed perpendicular thereto they form a wear protection for the radially outer edge of a lateral face of the grinding roll. In the illustrated embodiment the retaining element 15 also has a second wear protection element 17 secured to the exposed side face of the retaining element and flush with the lateral face of the grinding roll in order to protect such face of the retaining element from wear.

Adjacent wear protection elements are preferably disposed at such a small distance or gap from one another that no autogenous wear protection is formed between them.

The wear protection elements can also be disposed over the entire width of the grinding roll. In the illustrated embodiment profiled bodies 18 are provided (see FIG. 4) for the central region. These profiled bodies 18 may be constructed in the same way as the wear protection elements 11 or in another way. They project upwards and are preferably spaced axially and circumferentially from one another in such a way that during the grinding process the material to be comminuted becomes embedded in the interstices or gaps formed in the circumferential direction and forms an autogenous wear protection layer there.

Figure 4:
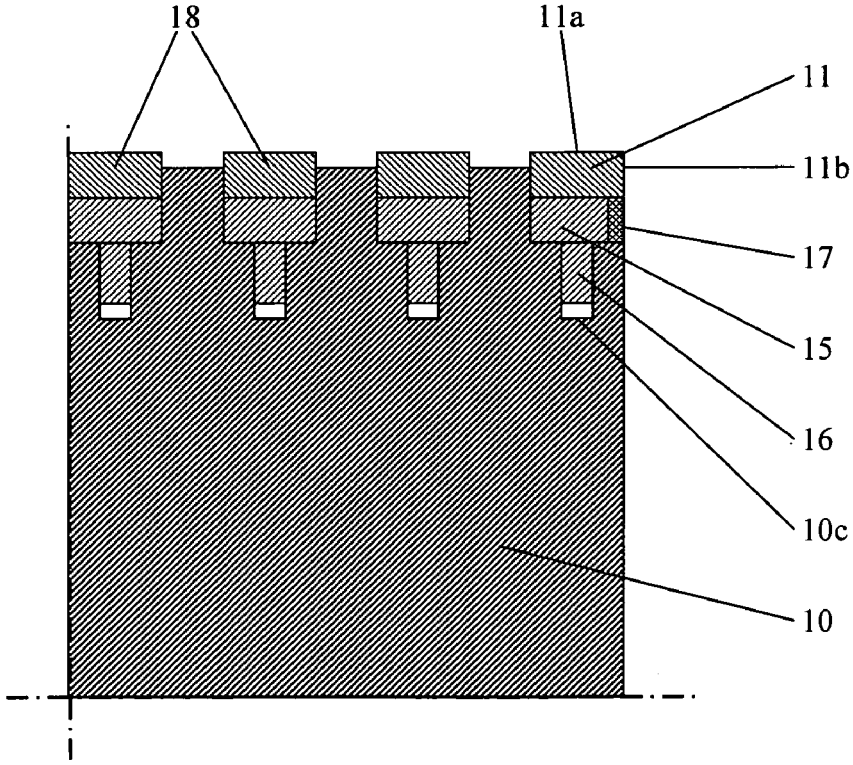
FIG. 4 shows a schematic cross-sectional representation in the region of the edge of a roll.

The wear protection elements can be disposed on the edge of the roll or also in the centre of the roll, flush with the base material, so that no profiling is produced in the axial direction. Optionally, the wear protection elements 11 disposed on the roll ends can also project beyond the surface of the basic roll body 10, as shown in FIG. 4. Thus the wear protection elements 11 form a bulkhead over the entire circumference of the roll and thereby prevent the material being comminuted from flowing in the axial direction (arrow 19).

Although the surface of the wear protection elements in the illustrated embodiment is of smooth construction, profiled surfaces could also be provided depending upon the application.

We claim:

1. A grinding roll rotatable about an axis comprising a cylindrical roll body having opposite ends and an outer surface including a groove having a width and a length wherein the length of the groove extends in a continuous circumferentially direction at each end of said body, each of said grooves extending inwardly of said body from the adjacent end of said body and being open both radially and axially of said body; and a plurality of wear protection elements accommodated in said grooves flush with the ends of said body, said wear protection elements being formed of material harder than that of said roll body and forming at least part of the outer surface of said roll body.

2. The grinding roll according to claim 1 wherein each of said wear protection elements is fixed to said roll body.

3. The grinding roll according to claim 1 wherein there is no substantial circumferential gap between adjacent ones of said wear protection elements.

4. The grinding roll according to claim 1 wherein no substantial axial gap exists between adjacent wear protection elements.

5. The grinding roll according to claim 1 wherein each of said wear protection elements is fixed on a retaining body formed of material of less hardness than that of said wear protection elements.

6. The grinding roll according to claim 5 wherein each said retaining body is soldered to the associated wear protection element.

7. The grinding roll according to claim 1 wherein each of said wear protection elements is fixed to one face of a retaining element having secured to its opposite face a projecting lug accommodated in a bore formed in said roll body.

8. The grinding roll according to claim 7 wherein each said lug is adhesively secured in its associated bore.

9. The grinding roll according to claim 1 wherein additional wear protection elements are secured to said roll body in that region of said roll body between the opposite ends thereof.

10. The grinding roll according to claim 1 wherein the wear protection elements at said opposite ends of said roll body project radially outwardly of said outer surface.

11. The grinding roll according to claim 1 wherein in plan view said wear protection elements are of angular configuration.

12. The grinding roll according to claim 1 wherein the circumferential spacing between adjacent wear elements is less than 5 mm.

13. The grinding roll according to claim 1 wherein the circumferential length of each of said wear protection elements is between 20 and 100 mm.

14. The grinding roll according to claim 1 wherein each of said wear protection elements is supported on a retaining body formed of material of less hardness than that forming said wear protection elements, each said retaining body being interposed between said roll body and the associated wear protection element.

15. The grinding roll according to claim 1 wherein each said wear protection element has two exposed surfaces one of which parallels the outer surface of said roll body and the other of which is perpendicular to said one exposed surface.

16. The grinding roll according to claim 1 wherein each said wear protection element is fixed on a retaining body secured to said roll body at one end thereof, and wherein each said retaining body has a second wear protection element secured to said roll body and flush with a lateral face of said one end of said roll body.

* * * * *